US008669839B2

(12) United States Patent
Yokoyama et al.

(10) Patent No.: US 8,669,839 B2
(45) Date of Patent: Mar. 11, 2014

(54) LAMINATED INDUCTOR

(71) Applicant: Taiyo Yuden Co., Ltd., Tokyo (JP)

(72) Inventors: Ichirou Yokoyama, Gunma (JP); Taisuke Suzuki, Gunma (JP); Yasuyuki Taki, Gunma (JP); Kazuhiko Oyama, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/754,772

(22) Filed: Jan. 30, 2013

(65) Prior Publication Data

US 2013/0200980 A1 Aug. 8, 2013

(30) Foreign Application Priority Data

Feb. 8, 2012 (JP) ..... 2012-025608

(51) Int. Cl.

| | |
|---|---|
| ***H01F 5/00*** | (2006.01) |
| ***H01F 27/02*** | (2006.01) |
| ***H01F 27/24*** | (2006.01) |
| ***H01F 27/28*** | (2006.01) |

(52) U.S. Cl.

USPC ..... 336/200; 336/83; 336/234; 336/223

(58) Field of Classification Search

USPC ..... 336/200, 223, 233, 234, 232, 180, 186, 336/83

See application file for complete search history.

(56) References Cited

U.S. PATENT DOCUMENTS

| | | | | |
|---|---|---|---|---|
| 7,173,508 | B2 | 2/2007 | Anbo et al. | |
| 8,093,981 | B2 | 1/2012 | Chung | |
| 8,193,894 | B2 * | 6/2012 | Miyoshi et al. | 336/200 |
| 2003/0117230 | A1 * | 6/2003 | Shin | 333/116 |
| 2008/0012679 | A1 | 1/2008 | Okabe et al. | |
| 2008/0257488 | A1 | 10/2008 | Yamano | |
| 2011/0133881 | A1 | 6/2011 | Nakajima et al. | |

FOREIGN PATENT DOCUMENTS

| | | |
|---|---|---|
| JP | 2001-358016 A | 12/2001 |

* cited by examiner

*Primary Examiner* — Alexander Talpalatski
*Assistant Examiner* — Mangtin Lian
(74) *Attorney, Agent, or Firm* — Law Office of Katsuhiro Arai

(57) ABSTRACT

A laminated inductor includes: a laminate constituted by multiple insulator layers; external electrodes formed on the outside of the laminate; and a coil conductor formed spirally inside the laminate, wherein the coil conductor has leaders that electrically connect to the external electrodes and a coil body other than the leaders, wherein the coil conductor has conductive patterns formed on the insulator layers, and via hole conductors that penetrate through the insulator layers and electrically connect the multiple conductor patterns, wherein all of the conductor patterns constituting the coil body are either a C-shaped pattern or line-shaped pattern, wherein the coil body has a partial structure where two or more C-shaped pattern layers are stacked together successively, and wherein the number of C-shaped patterns in the coil body is greater than that of line-shaped patterns.

2 Claims, 6 Drawing Sheets

LAMINATED INDUCTOR

BACKGROUND

1. Field of the Invention

The present invention relates to a laminated inductor.

2. Description of the Related Art

As electronic devices become smaller and support multiple bandwidths in recent years, the market is demanding laminated inductors that are smaller, higher in Q, and offering narrower inductance steps and smaller induction deviation. With conventional laminated inductors, the coil is formed by combining multiple conductor patterns obtained from multiple screen masks, or combining multiple conductor patterns obtained by shifting identical screen masks. As the laminated inductor becomes smaller, the core area of its coil decreases and inductance drops, while at the same time the magnetic flux does not pass through as effectively and the inductor's Q-value drops as a result. FIG. 6 is a schematic exploded view of an example of laminated inductor based on prior art, where conductor patterns B21 to B29, B210 to B212 of specified shapes are formed on insulator layers A22 to A29, A210 to A213, respectively, and these conductor patterns are electrically connected by via hole conductors C21 to C29, C210 to C215, to constitute a laminated inductor comprising a coil conductor spirally formed in a laminate.

According to Patent Literature 1, multiple sets of a pair of ferrite sheets, each of which has a conductor pattern of the same shape and both of which are stacked one atop another to form a double-conductor pattern, are stacked together and the conductor patterns in adjoining sets are interconnected by column-shaped through holes at positions where the patterns cross each other at right angles, to form a double-coil conductor winding spirally. It is claimed that, according to the constitution of FIG. 6 and constitution described in Patent Literature 1, where coil wires are arranged and connected in parallel, rise of direct-current resistance can be prevented, while high Q-value can be achieved at the same time.

BACKGROUND ART LITERATURES

[Patent Literature 1] Japanese Patent Laid-open No. 2001-358016

SUMMARY

According to the constitution described in Patent Literature 1 or FIG. 6, a coil is formed by parallel wires and consequently the coil becomes longer and achieved inductance becomes smaller. An object of the present invention is to provide a laminated inductor offering high Q-value, while ensuring high inductance.

After studying in earnest, the inventors completed the present invention, the details of which are described below.

The laminated inductor proposed by the present invention comprises a laminate constituted by multiple insulator layers, and a coil conductor formed in a spiral shape inside the laminate. This coil conductor has leaders that connect electrically to external electrodes, and parts of the coil conductor other than the leaders are collectively referred to as the "coil body." This coil conductor has conductor patterns formed on insulator layers, and via hole conductors that penetrate through the insulator layers and electrically connect the multiple conductor patterns. A conductor pattern formed on some insulator layers represents a C-shaped pattern that includes the four corners, and has an open part on one side, of a roughly rectangular shape. A conductor pattern formed on other insulator layer(s) is a line-shaped pattern (or a lower case letter "l"-shaped pattern) corresponding to the open part of one side of the C-shaped pattern of the roughly rectangular shape. The coil body is constituted only by C- and line-shaped patterns and via hole conductors. The coil body has a partial structure where two or more C-shaped pattern layers are stacked together successively, and the number of C-shaped patterns in the coil body is greater than that of line-shaped patterns.

Preferably the leaders of the coil conductor are electrically connected to the coil body through multiple parallel via hole conductors. Or, preferably the length of the line-shaped pattern is equal to or less than 30% of the total length of the four sides (along the center line) of the roughly rectangular shape constituting the C-shaped pattern.

According to the present invention, both high inductance and high Q-value can be achieved. To be specific, C-shaped patterns ensure a roughly rectangular core area which is relatively large with respect to the size of the laminate, while the fewer number of line-shaped patterns means that the coil length can be suppressed and consequently high inductance is achieved. In addition, stack of multiple C-shaped patterns in parallel leads to lower resistance and consequently high Q-value.

Any discussion of problems and solutions involved in the related art has been included in this disclosure solely for the purposes of providing a context for the present invention, and should not be taken as an admission that any or all of the discussion were known at the time the invention was made.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DESCRIPTION OF THE SYMBOLS

10 Laminated inductor

A1 to A15 Insulator layer

Figure 1:
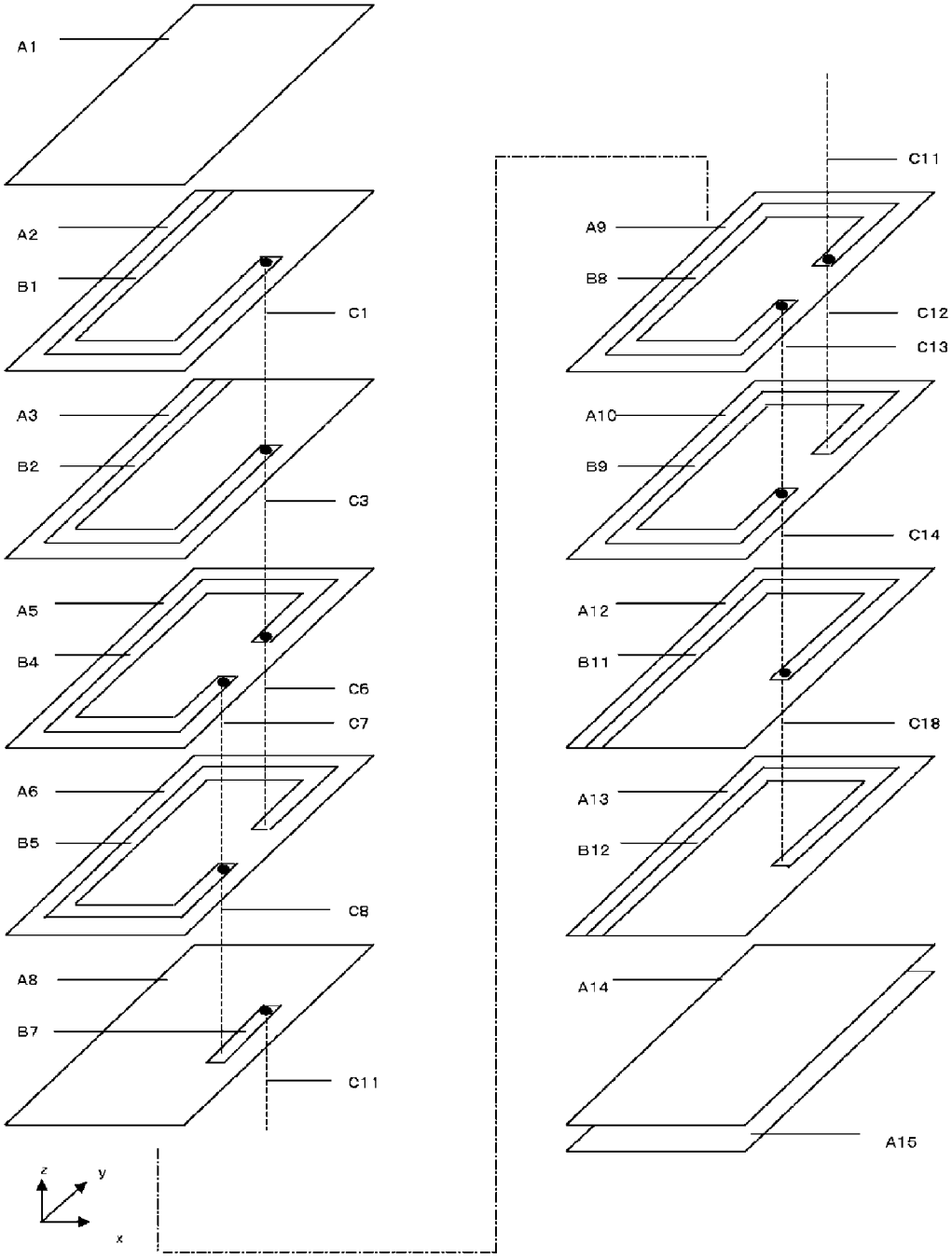
FIG. 1 is a schematic exploded view of an example of a laminated inductor conforming to the present invention.

B1 to B12 Conductor pattern
C1 to C18 Via hole conductor
D1, D2 External electrode

DETAILED DESCRIPTION OF EMBODIMENTS

The present invention is described below by referring to the drawings as deemed appropriate. It should be noted, however, that the present invention is not at all limited to the illustrated embodiments and that the scale of each part of the drawings is not necessarily accurate because characteristic parts of the present invention may be emphasized in the drawings.

The laminated inductor proposed by the present invention comprises a laminate constituted by multiple insulator layers, and a coil conductor formed in a spiral shape inside the laminate. FIG. 1 is a schematic exploded view of an example of a laminated inductor conforming to the present invention. Conductor patterns B1 to B12 are formed on insulator layers A2 to A13. The conductor patterns formed on different insulator layers are electrically interconnected through via hole conductors C1 to C18, and these via hole conductors C1 to C18 each penetrate through at least one insulator layer. In the figure, the via hole conductors penetrate through the insulator layers at the locations indicated by black circles. The conductor patterns B1 to B12 and via hole conductors C1 to C18 constitute a spirally formed coil conductor.

Figure 2:
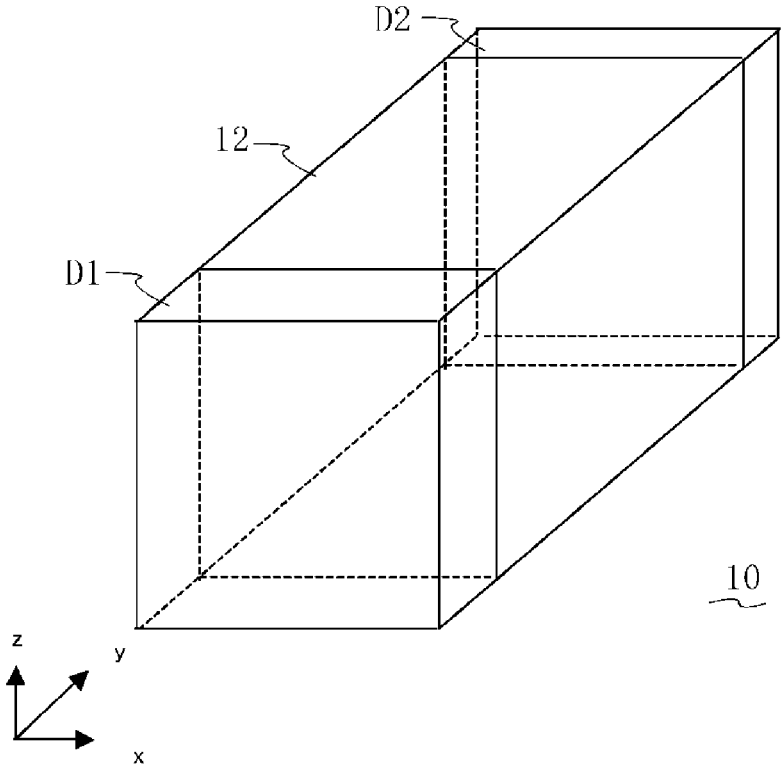
FIG. 2 is a schematic perspective view of an example of a laminated inductor conforming to the present invention.

FIG. 2 is a schematic perspective view of an example of a laminated inductor conforming to the present invention. External electrodes D1, D2 are formed at both ends of the aforementioned laminate 12 constituted by multiple insulator layers. The conductor patterns B1, B2 and B11, B12 in FIG. 1 (not illustrated in FIG. 2) reach the ends of the laminate constituted by insulator layers and electrically connect to the external electrodes D1, D2 shown in FIG. 1, respectively. In the present invention, these conductor patterns provided to electrically connect to the external electrodes are referred to as "leaders." The conductor patterns other than the leaders and via hole conductors are collectively referred to as "coil body." In the embodiment shown in FIG. 1, the conductor patterns B4 to B9 and via hole conductors C5 and C13 constitute the coil body.

According to the present invention, as described later, the coil body is constituted only by the below-mentioned C- and line-shaped patterns and via hole conductors. Additionally, the present invention is characterized by the arrangement and numbers of C- and line-shaped patterns.

The C-shaped pattern represents a conductor pattern that includes the four corners of a roughly rectangular shape and has an open part on one side of the roughly rectangular shape. According to the embodiment in FIG. 1, the C-shaped pattern is indicated by the reference numerals B4, B5, B8 and B9. The roughly rectangular shape may be a rectangle as shown in FIG. 1, or oval or other shape that approximates a rectangle. "The C-shaped pattern . . . includes the four corners of a roughly rectangular shape" encompasses a case where the pattern includes the four corners as shown in FIG. 1, as well as a case where the pattern includes locations that are recognized as corners of an approximate rectangle when the roughly rectangular shape does not have clear corners. The C-shaped pattern has an open part on one side of the roughly rectangular shape. As such, the C-shaped pattern specifies a majority of the core area.

The line-shaped pattern corresponds to the open part of one side of the C-shaped pattern of roughly rectangular shape. According to the embodiment in FIG. 1, the line-shaped pattern is indicated by the reference numeral B7. The line-shaped pattern may be a straight line as shown in FIG. 1, or curved line constituting a part of an oval shape, in accordance with the actual shape of the roughly rectangular shape. The length of the line-shaped pattern is preferably equal to or less than 30%, and more preferably between 10 and 20%, of the total length of the four sides of the roughly rectangular shape constituting the C-shaped pattern. In other words, preferably the length of the line-shaped pattern is equal to or less than three-sevenths of the length of the C-shaped pattern. The length of the line-shaped pattern may be increased above the length of the open part in the C-shaped pattern for the purpose of greater reliability of electrical connection, as long as the effects of the present invention are not negatively affected.

According to the present invention, conductor patterns included in the coil body satisfy the requirements specified below:

(1) All conductor patterns are either a C-shaped pattern or line-shaped pattern.

(2) Two or more C-shaped pattern layers are stacked together in parallel in at least one location.

(3) The number of C-shaped patterns is greater than that of line-shaped patterns.

Based on the above, naturally, insulator layers on which a C-shaped pattern is formed, and insulator layer on which an line-shaped pattern is formed, are adjoining each other in at least one location. This way, a single-turn coil of roughly rectangular shape is constituted. Here, since the core area is primarily determined by the C-shaped pattern, a majority of the accuracy of the core area depends on the shape accuracy (printing accuracy, etc.) of the C-shaped pattern, and thus the accuracy of other adjoining pattern, position accuracy at the time of lamination, etc., have little impact on the accuracy of the core area. With the laminated inductor 10 conforming to the present invention, change in inductance can be reduced. In general, the inductance L is proportional to (S/I), where I represents the coil length and S represents the core area. Accordingly, the laminated inductor 10 subject to less variation in core area S is subject to less change in inductance. This makes it easy to improve the accuracy of the core area of the laminated inductor as a whole, leading to less variation in inductance.

In addition, the core area can be widened by constituting the C-shaped pattern by effectively utilizing the size of the insulator layer, which makes it possible to increase the value of inductance relative to the size of the insulator layer, i.e., the size of the laminated inductor. Moreover, the relatively smaller number of line-shaped patterns means that the coil length can be shortened, and improvement of inductance can be expected from this viewpoint, as well.

The Q-value of the laminated inductor is proportional to $(2\pi fL/R)$, where L represents the inductance, f represents the frequency, and R represents the resistance. Accordingly, the R-value is expected to decrease, and consequently the Q-value is expected to improve, due to the larger L-value and shorter line-shaped pattern as mentioned above.

Figure 3:
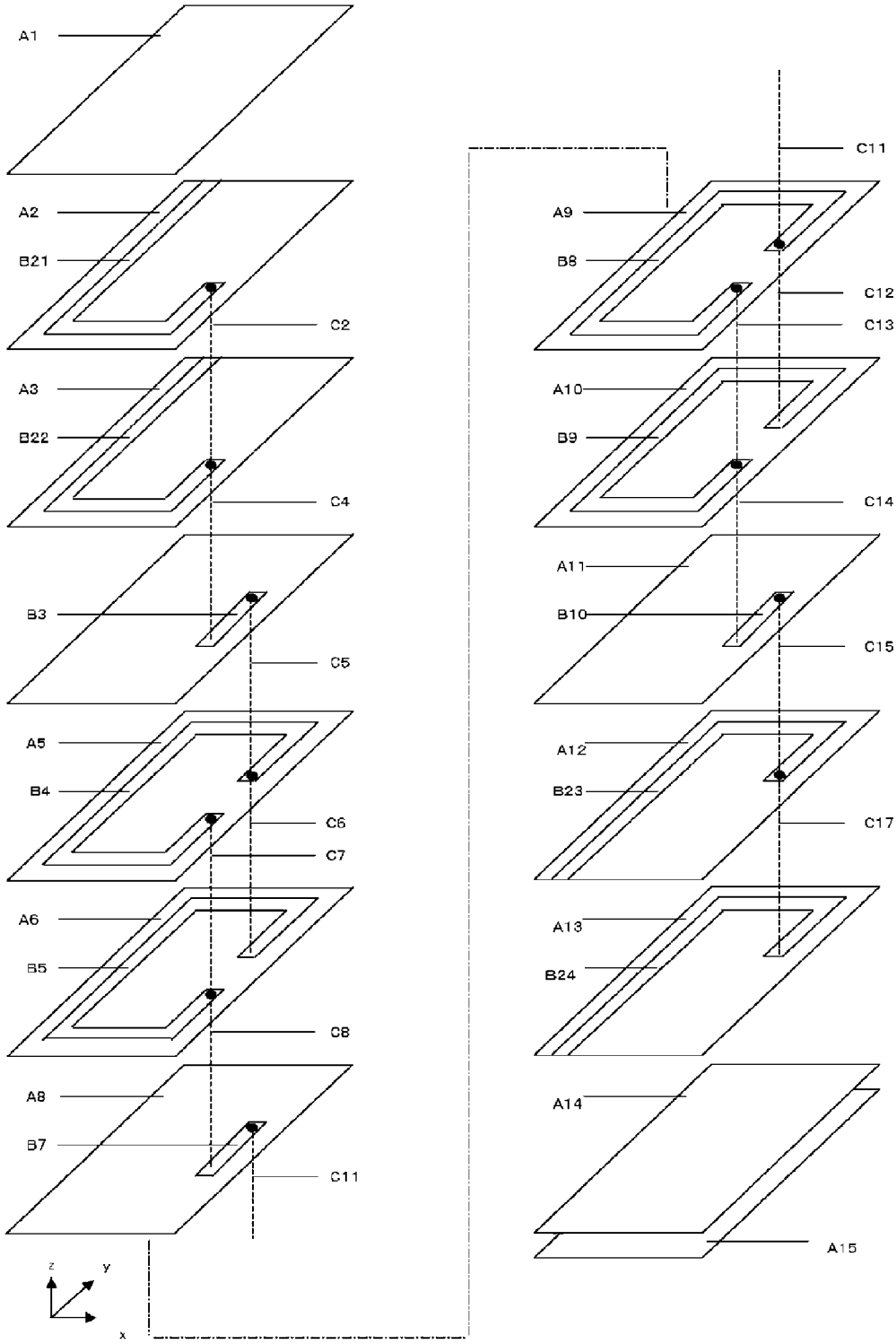
FIG. 3 is a schematic exploded view of another example of a laminated inductor conforming to the present invention.
Figure 4:
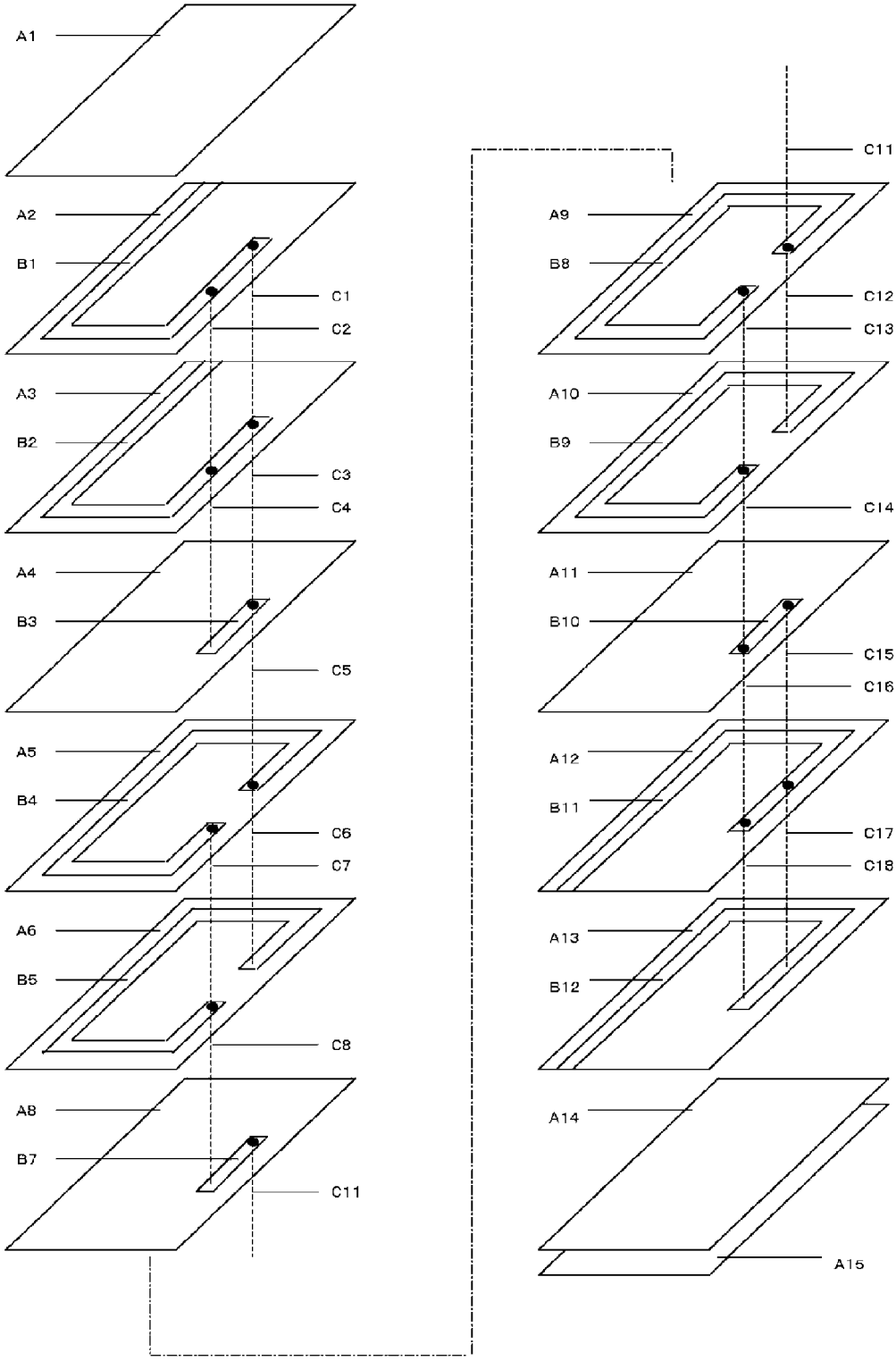
FIG. 4 is a schematic exploded view of yet another example of a laminated inductor conforming to the present invention.
Figure 5:
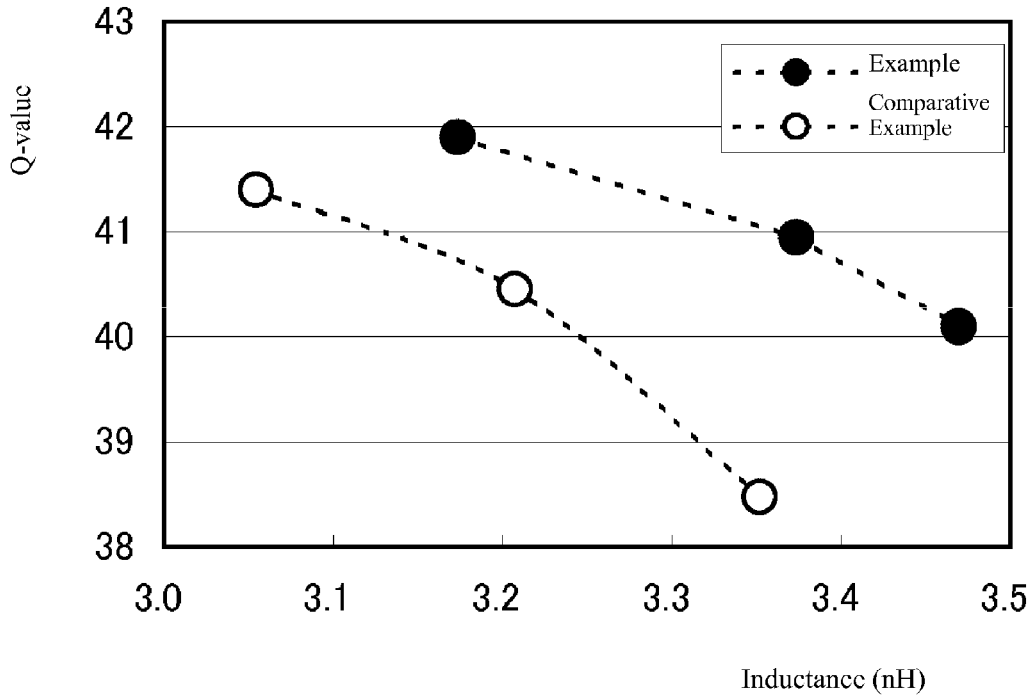
FIG. 5 is a graph plotting the inductances and Q-values in the Example and Comparative Example.

In the embodiment of FIG. 1, a double-turn coil conductor is constituted by four C-shaped patterns and one line-shaped pattern. Here, the C-shaped patterns are connected in parallel in two pairs. This embodiment is stated as "C-C-l-C-C." FIG. 3 is a schematic exploded view of another example of laminated inductor conforming to the present invention. In the embodiment of FIG. 3, the coil body represents an "l-C-C-l-C-C-l" stack of layers, according to the above notation. FIG. 4 is a schematic exploded view of another example of laminated inductor conforming to the present invention. Also in the embodiment of FIG. 4, the coil body represents an "l-C-C-l-C-C-l" stack of layers. According to the present invention, embodiments where layers are stacked together in different ways are also acceptable; for example, three or more C-shaped pattern layers may be stacked together in parallel, or line-shaped patterns may be layered at some parts.

It should be noted that, in the embodiment of FIG. 4, the leaders of the coil conductor are electrically connected to the coil body through multiple parallel via hole conductors. In this embodiment, the aforementioned resistance R can be reduced further, which is expected to improve the Q-value.

A more specific embodiment is explained below, but it should be noted that this explanation does not limit the present invention in any way. Here, the lamination direction of the laminated inductor 10 is defined as the z-axis direction, the direction along the short side of the laminated inductor 10 is defined as the x-axis direction, and the direction along the long side of the laminated inductor 10 is defined as the y-axis direction. The x-axis, y-axis and z-axis intersect one another at right angles. The laminated inductor 10 has a laminate 12 and external electrodes D1, D2. The external electrodes D1, D2 electrically connect to the coil conductor, respectively, extend in the z-axis direction, and are provided on the opposing side faces of the laminate 12. Under this embodiment, the external electrodes D1, D2 are provided in a manner covering the two side faces positioned at both ends in the y-axis direction. In an embodiment described in FIG. 1, the laminate 12 is constituted by insulator layers A1 to A15 laminated in the z-axis direction. Under this embodiment, the insulator layers A1 to A9 are made with a material whose main ingredient is glass, and have a rectangular shape. The coil conductor has a spiral shape that extends in the z-axis direction while turning, and includes conductor patterns B1 to B12 and via hole conductors C1 to C18. The conductor patterns B1 to B12 are formed on the main sides of the insulator layers A2 to A13, respectively, and laminated together with the insulator layers A1, A14 and A15. Each conductor pattern is made with a conductive material such as Ag. The conductor patterns B1 and B5 are leaders. The conductor patterns B1, B2 connected in parallel, and coil conductors B11, B12 also connected in parallel, connect to the external electrodes D1, D2, respectively. The C-shaped conductor patterns B4, B5 are interconnected in parallel and also connected, through the line-shaped conductor pattern B7, to the C-shaped conductor patterns B9, B10 that are interconnected in parallel. Additionally, the conductor patterns B2, B4 and conductor patterns B9 and B11 are connected, to electrically connect the external electrodes D1, D2. It should be noted that the conductor patterns are connected by the via hole conductors C1 to C18.

According to the aforementioned embodiment shown in FIG. 3, the conductor patterns B21, B22 connected in parallel constitute the leaders, and these leaders are connected, through the single line-shaped conductor pattern B3 layer, to the C-shaped conductor patterns B4, B5 connected in parallel. Furthermore, the conductor patterns B23, B24 connected in parallel are connected, through the conductor pattern B10, to the conductor patterns B8, B9 connected in parallel. According to the embodiment shown in FIG. 4, the conductor patterns B1, B2 connected in parallel constitute the leaders, and these leaders are connected, through the conductor pattern B3, to the conductor patterns B4, B5 connected in parallel. Furthermore, the conductor patterns B11, B12 connected in parallel are connected, through the coil conductor B10, to the conductor patterns B8, B9 connected in parallel. According to the embodiment of FIG. 4, the via hole conductors C1 to C4, C15 to C18 electronically connecting the leaders and coil body are arranged in pairs in parallel.

Here, the material for insulator layers may be ferrite, dielectric ceramics, magnetic material using soft magnetic alloy powder, or resin into which magnetic material is mixed, etc., in addition to material whose main ingredient is glass.

A typical manufacturing method for such laminated inductor is explained by using the embodiment of FIG. 1 as an example. It should be noted, however, that the present invention is not limited to this manufacturing method. Multiple insulating green sheets are prepared as precursors to insulator layers A1 to A15. The green sheets are formed by coating a film with an insulating slurry whose main ingredient is glass, etc., according to the doctor blade method, etc. The thickness of green sheets is not limited in any way, but preferably 5 to 30 μm, such as 18 μm, for example. Through holes are then formed by laser processing, etc., at the specified positions on the insulating green sheets that will become insulating layers A2 to A12, or specifically at the positions where via hole conductors C1 to C18 are to be formed. Thereafter, a conductive paste being a precursor to conductor patterns B1 to B12 is printed, by means of screen mask, etc., at the specified positions on the insulating green sheets that will become insulator layers A2 to A12. The main ingredient of the conductive paste may be metal, such as silver, copper or the like.

Next, insulating green sheets which will become the insulator layers A1 to A15 are laminated in the order shown in FIG. 1, after which pressure is applied in the direction in which they are laminated, to pressure-bond the insulating green sheets. Thereafter, the pressure-bonded insulating green sheets are cut to individual chips, which are then sintered at a specified temperature (such as 800 to 900° C. or so) to form a laminate 12. Next, external electrodes D1, D2 are formed on this laminate 12. An electronic component 10 is thus formed. The external electrodes D1, D2 are formed by coating both end faces of the laminate 12 in the lengthwise direction with an electrode paste whose main ingredient is silver, copper, etc., followed by baking at the specified temperature (such as 680 to 900° C. or so) and electroplating. For this electroplating, Cu, Ni, Sn, etc., can be used. The laminated inductor 10 is completed through the aforementioned steps.

EXAMPLE

The results of fabrications and measurements carried out to illustrate the effects of the present invention more clearly, are explained below. To be specific, the laminated inductor of the Example having the structure shown in FIG. 1, and laminated inductor of the Comparative Example having the structure shown in FIG. 6, were manufactured. In the Comparative Example, the structure is such that all conductor patterns are interconnected in parallel in pairs of identically shaped patterns. In the Example, two C-shaped patterns connected in parallel, and one line-shaped pattern connecting the open part of the C-shaped pattern, are connected together to form a single-turn coil. Under both the Example and Comparative Example, laminated inductors were formed with one of three different circumferences (total lengths of the four sides of roughly rectangular shapes) of 1.06 mm, 1.00 mm and 0.94 mm, and line-shaped pattern length of 0.14 mm. The laminated inductors had a size of 0.6 mm×0.3 mm×0.3 mm, and the coil conductors were silver electrodes of 50 μm in line width and 8 μm in thickness.

Figure 6:
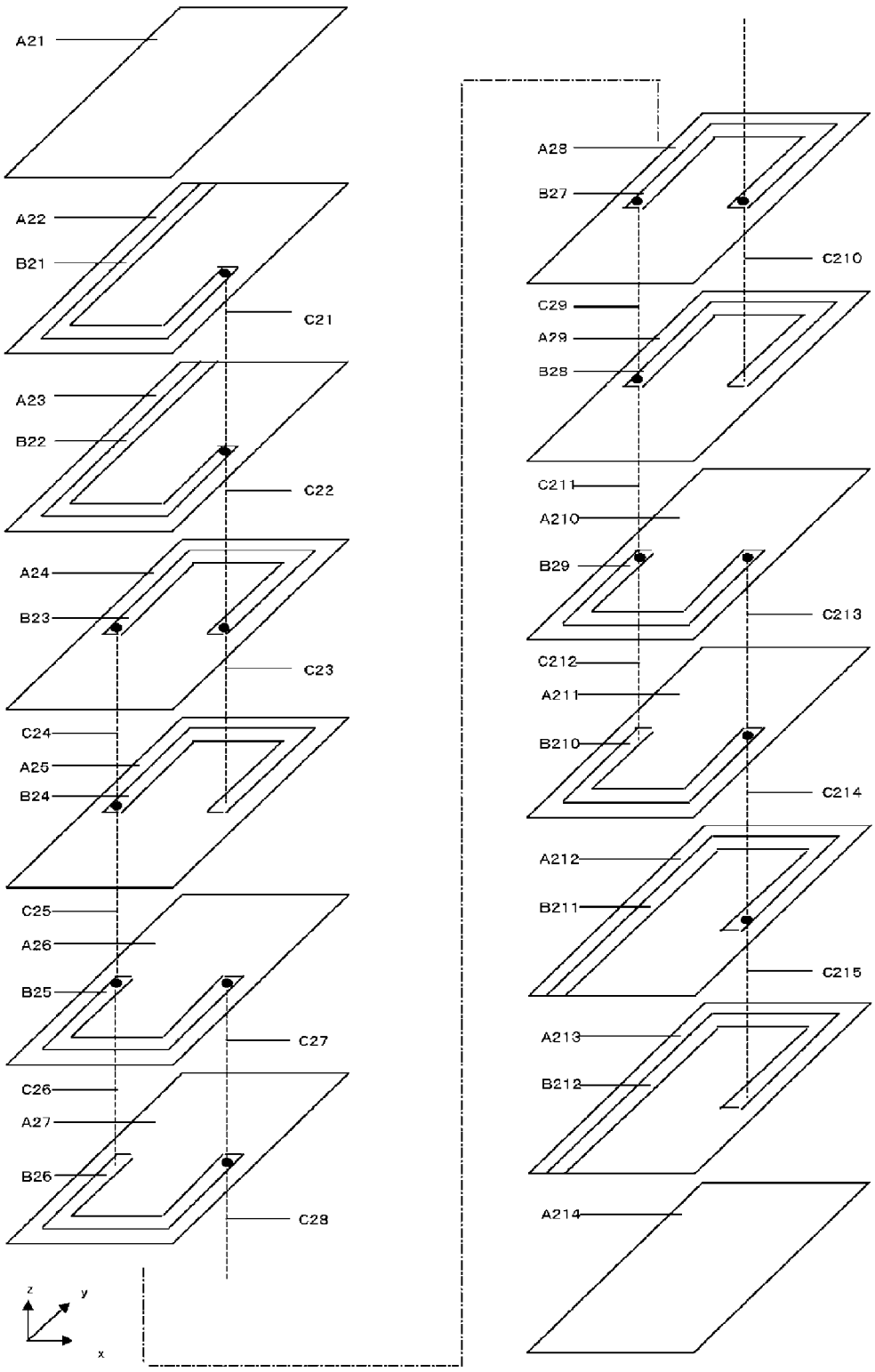
Fig. 6 (Background Art)
FIG. 6 is a schematic exploded view of an example of a conventional laminated inductor.

Inductance at 500 MHz and Q-value at 1800 MHz were measured on each of the three types of laminated inductors under the Example and Comparative Example. FIG. 6 is a graph plotting the inductances and Q-values measured under the Example and Comparative Example. Although the size of the laminated inductor and single-turn length of the coil conductor were the same between the Example and Comparative Example, the laminated inductors under the Example exhibited higher inductances and Q-values than those under the Comparative Example.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, an article "a" or "an" may refer to a species or a genus including multiple species, and "the invention" or "the present invention" may refer to at least one of the embodiments or aspects explicitly, necessarily, or inherently disclosed herein. In this disclosure, any defined meanings do not necessarily exclude ordinary and customary meanings in some embodiments.

The present application claims priority to Japanese Patent Application No. 2012-025608, filed Feb. 8, 2012, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A laminated inductor comprising:

a laminate constituted by multiple insulator layers;

external electrodes formed on the outside of the laminate; and a coil conductor formed spirally inside the laminate;

wherein the coil conductor has leaders that electrically connect to the external electrodes and a coil body other than the leaders;

wherein the coil conductor has conductive patterns formed on the insulator layers, and via hole conductors that penetrate through the insulator layers and electrically connect the multiple conductor patterns;

wherein a conductor pattern formed on some insulator layers represents a C-shaped pattern that includes four corners, and has an open part on one side, of a roughly rectangular shape, and a conductor pattern formed on other insulator layer(s) is a line-shaped pattern corresponding to the open part of one side of the C-shaped pattern of the roughly rectangular shape;

wherein all of the conductor patterns constituting the coil body are either the C-shaped pattern or line-shaped pattern;

wherein the coil body has a partial structure where two or more C-shaped pattern layers are stacked together successively;

wherein the number of C-shaped patterns in the coil body is greater than that of line-shaped patterns; and wherein a length of the line-shaped pattern is equal to or less than 30% of a total length of the four sides of the roughly rectangular shape constituting the C-shaped pattern.

2. A laminated inductor according to claim 1, wherein the leaders of the coil conductor are electrically connected to the coil body through multiple parallel via hole conductors.

* * * * *